US007171013B2

(12) United States Patent
Kosatos et al.

(10) Patent No.: US 7,171,013 B2
(45) Date of Patent: Jan. 30, 2007

(54) LOUD SPEAKER

(75) Inventors: Andrew Kosatos, Arlington, MA (US); Brian Cox, Somerville, MA (US); David Kroll, North Attleboro, MA (US); Miriam Korsunsky, Framingham, MA (US)

(73) Assignee: Boston Acoustic, Inc., Peabody, MA (US)

( * ) Notice: Subject to any disclaimer, the term of this patent is extended or adjusted under 35 U.S.C. 154(b) by 537 days.

(21) Appl. No.: 10/672,782

(22) Filed: Sep. 26, 2003

(65) Prior Publication Data

US 2004/0125974 A1 Jul. 1, 2004

Related U.S. Application Data

(60) Provisional application No. 60/414,064, filed on Sep. 27, 2002.

(51) Int. Cl.
*H04R 25/00* (2006.01)

(52) U.S. Cl. ..... 381/182; 381/186; 381/386

(58) Field of Classification Search ..... 381/182, 381/186, 386, 387, 391; 181/144, 145, 147
See application file for complete search history.

(56) References Cited

U.S. PATENT DOCUMENTS 5,635,686 A 6/1997 Fenton
6,282,297 B1 8/2001 Lin

*Primary Examiner*—Melur Ramakrishnaiah
*Assistant Examiner*—Tuan Duc Nguyen
(74) *Attorney, Agent, or Firm*—Sheehan, Phinney, Bass & Green, P.A.; Peter A. Nieves

(57) ABSTRACT

A loudspeaker system designed for ceiling installation. The system includes a woofer, a midrange speaker and a tweeter commonly supported on a rotatable support member which in turn is supported on and is rotatable with respect to an annular rim that is designed to be fixed about an opening in the ceiling. The woofer is aligned at one acute angle and the midrange speaker and tweeter at another acute angle to the annular rim. The mid range speaker and tweeter are partially segregated from the woofer by a baffle.

10 Claims, 3 Drawing Sheets

LOUD SPEAKER

The present invention claims the benefit of Provisional Application Ser. No. 60/414,064, filed Sep. 27, 2002. The present invention relates to a loud speaker and, in particular, to a loud speaker having multiple audio transducers that are mutually adjustable for purposes of improving performance.

BACKGROUND OF THE INVENTION

High-performance ceiling loud speakers often produce too much treble and midrange directly in front of the speaker and not enough to the sides of the speaker. This is particularly troublesome when the speaker is a ceiling speaker directed downwardly. This problem arises because at frequencies of interest, the woofer and tweeter are directional. In order to make the transducer less directional, the radiating area is made smaller. However, in a woofer, this adversely affects the bass performance. Another problem inherent in the production of speakers and particularly those that are used in a ceiling is the space available for them. Ceiling speakers must be shallow enough to fit in a space provided by standard ceiling joists. Further, it is desirable from an aesthetic point-of-view to minimize the profile and size of the visible and projecting portion of the ceiling speaker. In conventional ceiling speakers, this presents a problem, particularly with the alignment of the woofer and other transducers normally used.

SUBJECT MATTER OF THE INVENTION

The present invention is designed to overcome the problems referred to above and as well as other problems. In the present invention, three transducers including a woofer, a midrange speaker, and a tweeter are arranged in different non-parallel planes. A further feature of this invention is to partially cover the woofer with the mid-range and tweeter baffle and enclosure. By doing this, the amount of baffle the midrange projects from is increased. Accordingly, diffractions and reflections around the midrange are thereby minimized. These diffraction and reflection problems typically affect the mid-frequencies when the midrange driver or woofer is inadequately baffled or when the midrange driver is occluded by solid objects.

The present invention also contemplates providing means for angling the midrange and tweeter baffle with respect to the ceiling while allowing the entire woofer/midrange/tweeter system to rotate once installed. By this feature, the user is able to point the system to a preferred listening position.

It is thus an object of this invention to provide an improved speaker system by arranging a midrange tweeter baffle in a position that partially covers a woofer. By virtue of this 3-way system, the woofer does not receive the midrange signals that would be diffracted by the baffle in front of it. Moreover, the bass frequencies that the woofer produces are non-directional. Accordingly the angle the woofer is mounted at does not adversely affect the sound quality.

The foregoing objects and advantages of the present invention will be more clearly understood when considered in conjunction with the accompanying drawings in which:

DETAILED DESCRIPTION OF PREFERRED EMBODIMENT

The speaker system illustrated is designed to be fixed in a wall or ceiling. The design, however, is preferably intended for ceiling use with the unit fitting between ceiling joists and with the bottom of the speaker sitting in an opening shaped and sized to receive the speaker system. In its preferred use as a ceiling speaker, the unit should be installed in an optimal position taking into consideration the location of furniture in the room. Additionally, the invention provides a tweeter and midrange baffle which is angled to deliver accurate, on-axis response to the listening position. The baffle should be properly positioned to deliver the best sound. For optimum results, a pair of speakers should be used on either side of the listening area with the speaker baffles rotated towards the listening area. The system may also be used as a front or main speaker, or as a surround speaker in accordance with known technology.

When installing the speaker in a ceiling, the ceiling is appropriately prepared to receive the speaker. A hole is cut in the ceiling shaped and sized to receive the loudspeaker body with the mounting ring or member 1 flush with the outer surface of the ceiling. Suitable joists are provided with securing the loudspeaker system in position as hereafter described. Additionally, fiberglass insulation and other suitable preparation may be provided in accordance with known installation techniques.

Figure 3:
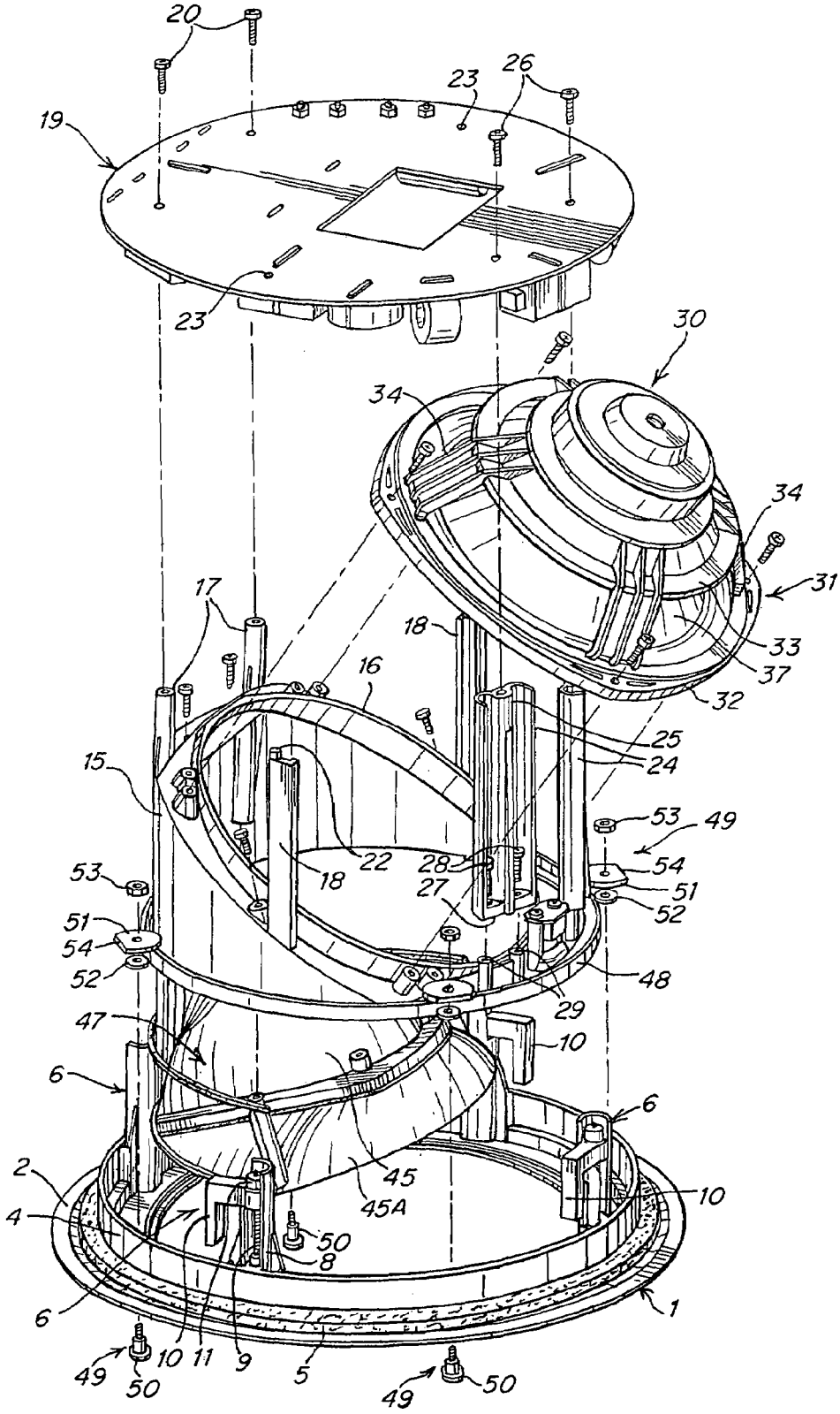
FIG. 3 is an exploded view of the speaker components.
Figure 4:
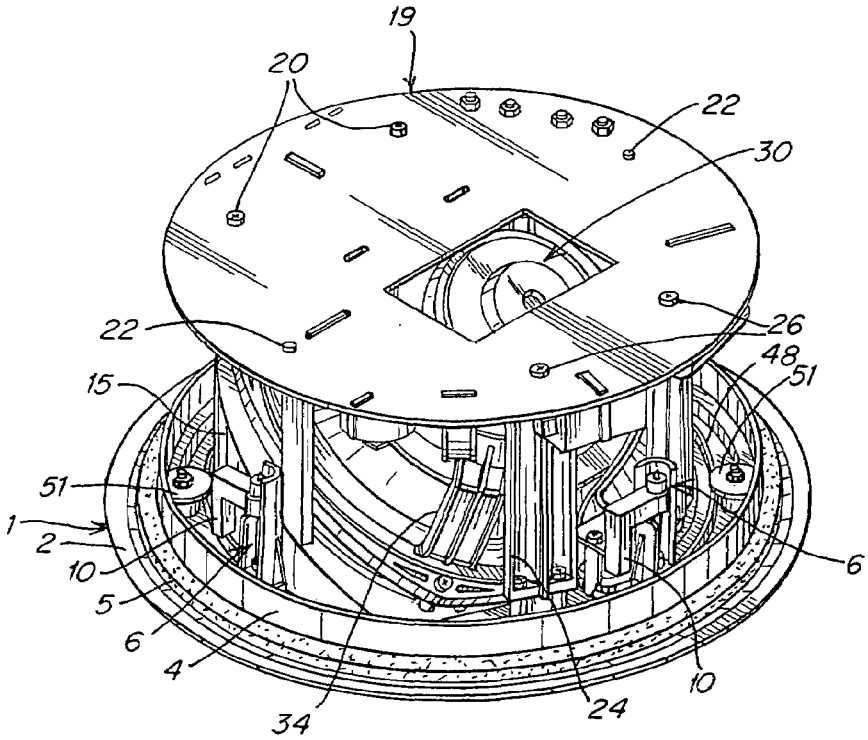
FIG. 4 is a perspective view of the assembled speaker.
Figure 5:
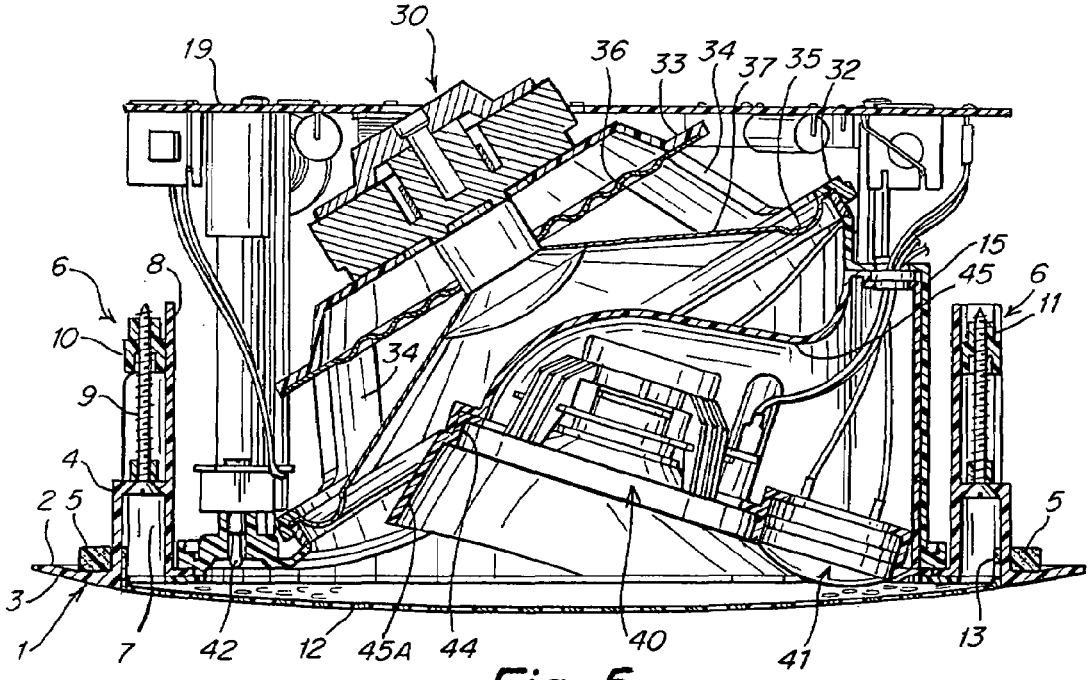
FIG. 5 is a cross-sectional view of the speaker.

The mounting ring or member 1 is formed with an annular rim 2 having an outer radius greater than the radius of the hole cut in the ceiling and an inner radius less than the hole cut in the ceiling. The rim 1 may be beveled as illustrated in FIG. 5. It is integrally formed with an upwardly extending annular flange 4. An annular gasket 5 may be positioned at the corner formed by the upper surface of the rim 2 and the outer surface of the integrally formed flange 4. The speaker system is secured with the upper surface of the rim 2 abutting the ceiling with the gasket 5 providing a sealing means. Integrally formed with the ring 1 are a plurality of locking mechanisms 6. Preferably four of these mechanisms are provided, radially arranged about the speaker system at ninety degrees to one another. Each of these locking mechanisms 6 is integral with the ring 1. It comprises an upwardly extending housing formed with a recessed opening 7 extending upwardly from the inner edge of the rim 2. The recessed opening 7 in part is formed by an upwardly extending semi-cylindrical shroud 8 that receives an adjusting screw 9. The adjusting screw 9 is threaded through an upper wall defining the upper end of the recessed opening 7 into a threading engagement with a locking bracket 10. The locking bracket 10 has an inverted L-shape with the lateral arm of the locking bracket having a cylindrical end 11 (FIG. 3) into which the adjusting screw 9 is threaded. Rotation of the adjusting screw 9 causes rotation of the locking bracket 10 from the position illustrated in FIG. 3 to a position outwardly of the ring 1. In this position the bracket 10 may be rotated to engage joists or other supporting mechanisms within a ceiling structure (not shown). This arrangement is designed to secure the loudspeaker system within the ceiling opening.

A grill 12 (FIG. 5) having a conventional surface which may, for example, comprise a series of perforated designs secured within the annular rim 2 by frictional interengagement of the upwardly extending peripheral flange 13 may be integrally formed with the grill.

A speaker support 15 is positioned over the ring 1. The speaker support 15 is formed with a partially cylindrical wall with an upper edge 16 extending at an angle of approximately forty-five degrees to the plane of the ring 1 and with an annular ring 48 defining its bottom, with the bottom resting on rim 2. At the rear of the speaker support 15 are a pair of parallel upwardly extending posts 17 that are axially threaded at their upper end. Additional posts 18 integrally formed with the speaker support 15 extend upwardly from its upper edge at about ninety degrees from post 17. A printed circuit board 19 is secured to the speaker support 15 by engagement with the tops of posts 17 and 18 with screws 20 projecting through openings in the printed circuit board 19 into threaded engagement with the threaded openings in the tops of post 17. The tops of posts 18 are formed with studs 22 that project through aligned openings 23 in the printed circuit board 19. Additional support is provided for the printed circuit board 19 by braces 24. These braces 24 have a center post 25 that is axially threaded at its upper end to receive screws 26 that extend downwardly through the aligned openings in the printed circuit board 19 into posts 25. The lower end of the braces 26 are formed with a bottom wall 27 on either side of the center post 25. Screws 28 are threaded through the bottom wall into posts 29 which are integrally formed with support 15 to secure the base of the braces.

A woofer assembly 30 includes a basket 31. The basket 31 has a lower ring 32 and an upper ring 33 interconnected by a plurality of struts 34. The upper ring 33 is shaped to receive and support the magnet, voice, coil and spider 36 in a conventional fashion. The woofer is conventionally formed with a spider 36 and diaphragm 37. The periphery of the diaphragm 37 is secured to the inner annular edge of lower ring 32 by an annular suspension member 35 in a conventional fashion.

The woofer assembly is secured to the edge 16 of the support 15, thus aligning the spider 36 in a non-parallel relation to the rim 2.

The center axis of the woofer, consisting of a line extending axially through the magnet voice coil spider 36 and diaphragm of the woofer assembly 30 lies at an acute angle to the plane of the grill. The angle is in the order of forty-five degrees.

Positioned in front of the woofer assembly 30 is a midrange speaker 40 and tweeter 41. These components are radially aligned with the center axis of the speaker and extend at an angle from the plane in which the grill 12 lies. The angle of the midrange speaker 40 and tweeter 41 with respect to the plane in which the grille lies is more acute than the angle at which the woofer assembly 30 lies with respect to the plane of the grille.

Figure 1:
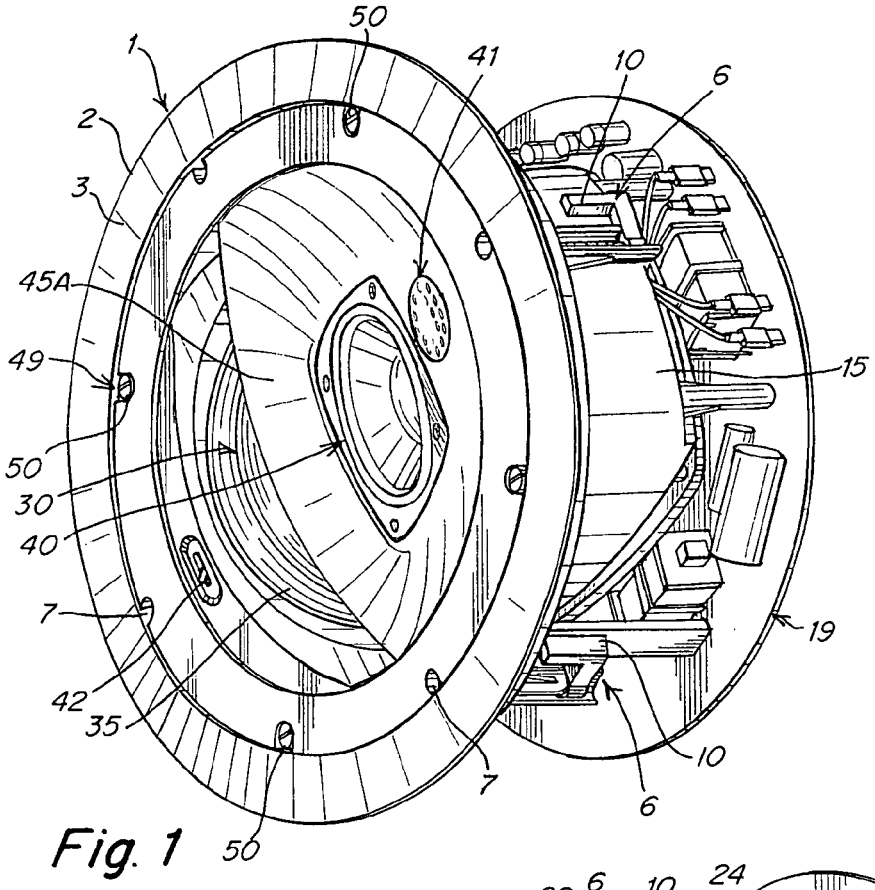
FIG. 1 is a perspective view of a preferred embodiment of the present invention with the grill cloth normally covering the speaker removed.
Figure 2:
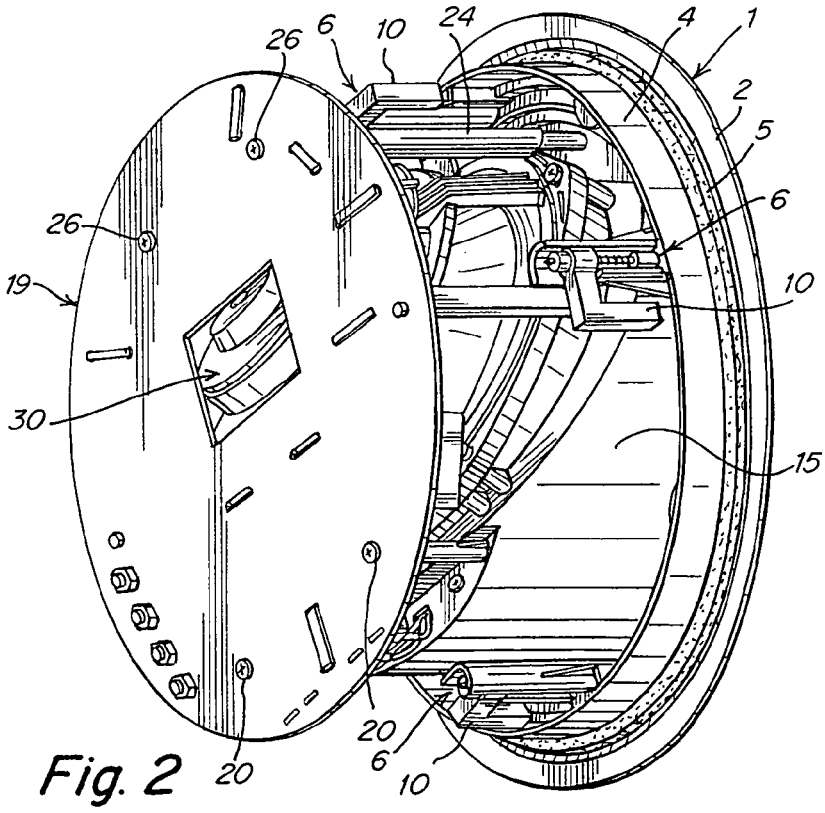
FIG. 2 is a perspective view of the speaker shown in FIG. 1 taken from the opposite side of the speaker.

A frame 41 (FIG. 5) supports the midrange speaker and tweeter in fixed relation to the woofer assembly. A baffle 45 is positioned between the woofer assembly 30 and the midrange speaker 40 and tweeter 41. The periphery of the baffle 45 extends slightly more than the 180° around, and is contiguous with the inner edge of the annular rim 2 over this distance. The baffle extends partially in front of the woofer assembly concealing slightly more than half of the woofer behind the baffle 45 as illustrated in FIG. 1. The midrange tweeter baffle 45 is thus contoured to direct sound from the tweeter and midrange in the direction angular to the primary direction in which sound emanates from the woofer. Thus, in the plane in which the direction of sound in the midrange is primarily located is angular to the plane in which the direction of sound from the woofer 6 is located. The baffle 45 may be formed of a solid, non-flexing material and includes the skirt 45*a* flared downwardly from the tweeter and midrange speaker. The baffle 45 and skirt 45*a* are rigidly secured to the midrange speaker 40 and tweeter 41 by suitable means including the support assembly 47.

The woofer assembly 30, midrange speaker 40, and tweeter 41 may be rotated relative to the ring 1, thus permitting the woofer, midrange speaker, and tweeter assembly to be angularly rotated for re-directing the sound after the unit has been installed in the ceiling. In this arrangement, the woofer assembly 30, midrange speaker 40, and tweeter 41 are all rigidly secured to the speaker support 15. The speaker support 15 includes at its lower edge an annular ring 48. This annular ring 48 may be integrally formed with the speaker support 15 at its lower edge. The radius of this annular ring 48 is greater than the inner radius of the annular rim 2. The speaker support 15 and its annular ring 48 may thus be axially rotated relative to the annular rim 2. This rotation is ordinarily restrained with the woofer midrange assembly and tweeter ordinarily fixed relative to the annular rim 2 unless adjustments are desired. Locking means are provided for securing the speaker support 15 and its annular ring 48 in fixed rotational position relative to the annular rim 2. There are preferably four locking systems means 49 radially arranged about the speaker system. Each locking system includes a screw 50 that extends upwardly through the annular rim 2 to engage the support washer 51, washer 52 and nut 53. The support washer is beveled on one side 54 with the side flush with the inner surface of flange 4. Rotation of the screw 50 will loosen or tighten the support washer 51 against the upper edge of annular ring 48. When tightened, the annular ring 48 is locked relative to the rim 2, thus preventing relative rotation of the woofer, midrange speaker and tweeter. When the screws 50 of the lock system are loosened, the unit may be rotated to any desired degree of rotation for optimum performance of the speaker system.

The system is acoustically driven by a conventional means including conventional cross-over circuits. The various components may be arranged on or secured to the printed circuit board 19. A boundary compensation switch 42 may be provided in an accessible position below the metal grill or cloth. The boundary compensation switch is connected to a circuit that adjusts the response of the speaker when mounted close to boundary junctions of a room such as an adjacent wall or a corner of the room. When the speaker is mounted close (in the order of 18") from the junction of two surface or less than 24" from the junction of three surfaces, a wall corner of a room, the boundary switch would normally be turned off.

The invention claimed is:

1. A loudspeaker system comprising a woofer, a midrange speaker, and a tweeter, the midrange speaker and the tweeter being positioned in front of the woofer, the loudspeaker system comprising:

support means having a mounting member shaped to be received in an opening, wherein said mounting member is in a first plane;

means for mounting the woofer on the support means, wherein a center axis of the woofer on the support means is at a first acute angle to the first plane;

means for securing the midrange speaker and the tweeter in front of the woofer, a plane of the midrange speaker and the tweeter being at a second acute angle with the first plane; and a midrange speaker and tweeter baffle positioned between the woofer, and the midrange speaker and tweeter, wherein the midrange speaker and tweeter baffle extends partially in front of the woofer.

2. The loudspeaker system of claim 1, wherein the baffle directs tweeter and midrange speaker sounds angular to a primary direction of sound emanating from the woofer.

3. The loudspeaker system of claim 2, wherein the baffle is a fructo conic baffle with one end secured to the face plane of the woofer.

4. The loudspeaker system of claim 3, wherein the mounting member further comprises an annular member, and wherein the loudspeaker further comprises a grill cover extending across and secured to the annular member, the support means including a support housing the baffle.

5. The loudspeaker system of claim 3, wherein the mounting member further comprises an annular member and wherein the loudspeaker system further comprises means for rotating the woofer, midrange speaker, and tweeter with respect to the mounting member.

6. A loudspeaker system comprising a woofer, a midrange speaker and a tweeter, where the midrange speaker and tweeter are positioned in front of the woofer, means supporting the woofer, speaker and tweeter for mounting within a structure having a surface with an opening therein with one side of the system essentially flush with the opening, means positioning the woofer within the structure with its axis at an acute angle to the surface, means positioning the speaker and tweeter intermediate the surface and the woofer with the axis of each of the speaker and tweeter at an acute angle to surface which angle is non-parallel to the angle of the woofer.

7. The loudspeaker system of claim 1, having means for relative axial rotation of said support means and said woofer mounting means.

8. The loudspeaker system of claim 1, wherein said woofer, midrange speaker, and tweeter are secured in fixed rotation to one another to said mounting means, and wherein the system further comprises means for rotating said support means and said means mounting said woofer relative to one another.

9. The loudspeaker of claim 1, wherein said first acute angle and said second acute angle are not the same.

10. The loudspeaker system of claim 1, wherein said second acute angle is larger than said first acute angle.

* * * * *